US011387611B2

(12) United States Patent
Smentek et al.

(10) Patent No.: US 11,387,611 B2
(45) Date of Patent: Jul. 12, 2022

(54) COAXIAL CONNECTORS FOR BOARD-TO-BOARD INTERCONNECTION

(71) Applicant: CommScope Technologies LLC, Hickory, NC (US)

(72) Inventors: David J. Smentek, Lockport, IL (US); Troy I. Vanderhoof, Prosper, TX (US); Amit Kaistha, Coppell, TX (US); Thomas G. Sheehe, Allen, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/014,265

(22) Filed: Sep. 8, 2020

(65) Prior Publication Data

US 2021/0098953 A1 Apr. 1, 2021

Related U.S. Application Data

(60) Provisional application No. 62/907,815, filed on Sep. 30, 2019.

(51) Int. Cl.
*H01R 9/05* (2006.01)
*H01R 24/50* (2011.01)
(Continued)

(52) U.S. Cl.
CPC ..... *H01R 24/50* (2013.01); *H01R 12/716* (2013.01); *H01Q 1/50* (2013.01)

(58) Field of Classification Search
CPC .. H01R 24/50; H01R 12/716; H01R 2201/02; H01R 13/2421; H01R 13/2414;
(Continued)

(56) References Cited

U.S. PATENT DOCUMENTS 6,166,615 A * 12/2000 Winslow ..... H01P 1/04 333/243
8,419,441 B1 4/2013 Topolewski et al.
(Continued)

FOREIGN PATENT DOCUMENTS

KR 20140145185 A 12/2014

OTHER PUBLICATIONS

"International Search Report and Written Opinion corresponding to International Application No. PCT/US2020/049679 dated Dec. 18, 2020".

(Continued)

*Primary Examiner* — Abdullah A Riyami
*Assistant Examiner* — Nelson R. Burgos-Guntin
(74) *Attorney, Agent, or Firm* — Myers Bigel, P.A.

(57) ABSTRACT

An assembly includes: first and second printed circuit boards (PCBs), the PCBs being disposed generally parallel to each other; a first coaxial connector mounted to the first PCB, the first coaxial connector comprising a first inner contact and a first outer connector body, the first outer connector body having a first thickness; and a second coaxial connector mounted to the second PCB, the second axial connector comprising a second inner contact and a second outer connector body. The second outer connector body includes an engagement surface, the engagement surface being flexible in a direction normal to the second PCB, the engagement surface having a second thickness that is greater than the first thickness.

14 Claims, 5 Drawing Sheets

(51) Int. Cl.
*H01R 12/71* (2011.01)
*H01Q 1/50* (2006.01)

(58) Field of Classification Search
CPC ..... H01R 12/91; H01R 12/00; H01Q 1/50; H05K 1/00
See application file for complete search history.

(56) References Cited

U.S. PATENT DOCUMENTS

| | | | | |
|---|---|---|---|---|
| 9,614,309 | B1 | 4/2017 | Miklinski et al. | |
| 2003/0224628 | A1 | 12/2003 | Korsunsky et al. | |
| 2012/0295478 | A1* | 11/2012 | Mrowka | H01R 24/50 439/578 |
| 2013/0157503 | A1* | 6/2013 | Sykes | H01R 24/44 439/578 |
| 2018/0254540 | A1* | 9/2018 | Yoo | G06F 1/1681 |
| 2018/0301837 | A1 | 10/2018 | Hoyack et al. | |
| 2019/0165525 | A1* | 5/2019 | Gartmann | H01R 24/542 |
| 2021/0083432 | A1* | 3/2021 | Lapkowicz | H01R 13/6597 |
| 2021/0098953 | A1* | 4/2021 | Smentek | H01R 12/716 |

OTHER PUBLICATIONS

"International Preliminary Report on Patentability corresponding to International Application No. PCT/US2020/049679 dated Apr. 14, 2022".

* cited by examiner

COAXIAL CONNECTORS FOR BOARD-TO-BOARD INTERCONNECTION

RELATED APPLICATION

The present application claims priority from and the benefit of U.S. Provisional Patent Application No. 62/907,815, filed Sep. 30, 2019, the disclosure of which is hereby incorporated herein by reference in full.

FIELD OF THE INVENTION

The present invention relates generally to wireless communications. In particular, they relate to improvements in wireless base station antenna and radio deployments.

BACKGROUND

One known wireless radio network system that may be mounted at the top of the tower comprises a remote radio unit (RRU) and a separate antenna. These components are mounted in separate locations and often are cabled together using jumper cables to pass radio frequency (RF) signals between them. In some installations, the RRU and the antenna have printed circuit boards (PCBs) (typically disposed parallel to each other) on which arrays of coaxial connectors are mounted that may plug into each other; in other instances, "board-to-board" connectors (B2B) that extend between the PCBs to interconnect the connectors on each PCB may be employed.

As can be imagined, the tolerances of the PCBs may require that some "float" (both axially and radially) be possible for the B2B connectors in order for them to connect fully. As such, it may be desirable for B2B connectors to have floating capability.

SUMMARY

As a first aspect, embodiments of the invention are directed to an assembly comprising: first and second printed circuit boards (PCBs), the PCBs being disposed generally parallel to each other; a first coaxial connector mounted to the first PCB, the first coaxial connector comprising a first inner contact and a first outer connector body, the first outer connector body having a first thickness; and a second coaxial connector mounted to the second PCB, the second axial connector comprising a second inner contact and a second outer connector body. The second outer connector body includes an engagement surface, the engagement surface being flexible in a direction normal to the second PCB, the engagement surface having a second thickness that is greater than the first thickness.

As a second aspect, embodiments of the invention are directed to an assembly comprising: first and second printed circuit boards (PCBs), the PCBs being disposed generally parallel to each other; and a coaxial connector mounted to the first PCB and to the second PCB, the coaxial connector comprising an inner contact with a first axial projection and an outer connector body having a second axial projection. The first PCB includes oversized mounting holes for the first and second axial projections, such that the axial and radial positions of the inner contact and the outer connector body can be adjusted relative to the first PCB prior to mounting thereto.

As a third aspect, embodiments of the invention are directed to an assembly comprising: first and second printed circuit boards (PCBs), the PCBs being disposed generally parallel to each other; a first coaxial connector mounted to the first PCB, the first coaxial connector comprising a first inner contact and a first outer connector body having a free end surface with a first thickness; and a second coaxial connector mounted to the second PCB, the second axial connector comprising a second inner contact and a second outer connector body. The second outer connector body includes an engagement surface, the engagement surface having a second thickness that is greater than the first thickness. The first outer connector body is configured to bow radially under axial compression induced by engagement between the free end surface of the first outer connector body and the engagement surface of the second outer connector body.

DETAILED DESCRIPTION

Figure 1:
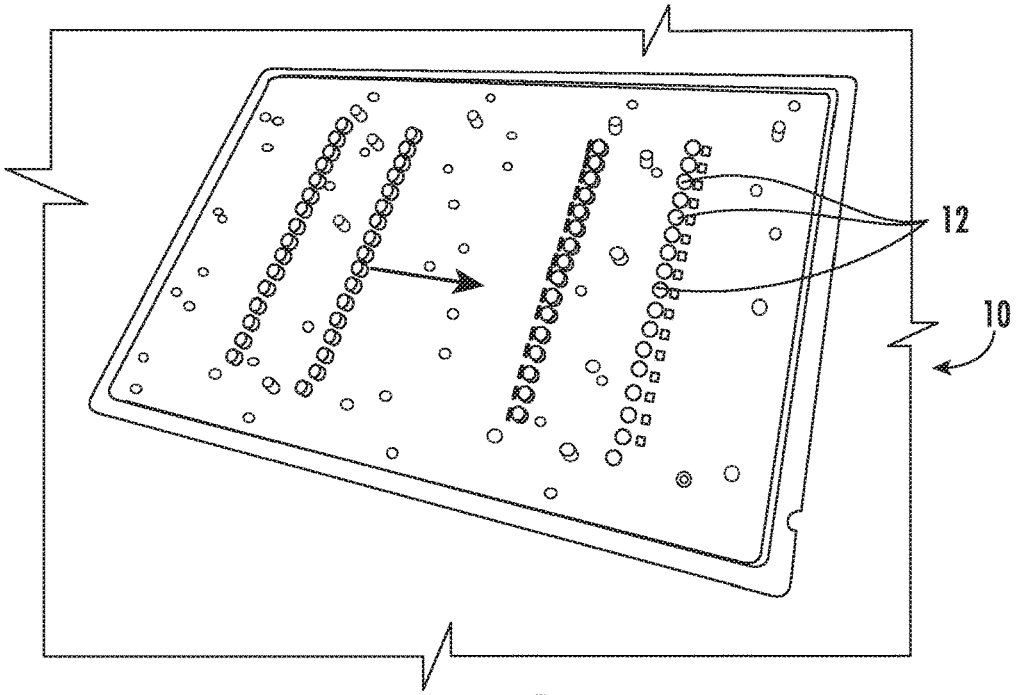
FIG. 1 is a perspective plan view of an exemplary PCB with an array of coaxial connectors mounted thereto.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will frilly convey the scope of the invention to those skilled in the art.

In the figures, certain layers, components or features may be exaggerated for clarity, and broken lines illustrate optional features or operations unless specified otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, any phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Referring now to the drawings, FIG. 1 illustrates a typical PCB 10 on which connectors 12 are mounted in an array. The PCB 10 may be mounted to a piece of telecommunications equipment, such as an antenna, that is to be connected with another PCB mounted to a separate piece of telecommunications equipment, such as an RRU. The PCB 10 is of conventional construction and as such may include electronic traces, vias, and electronic components that convey electronic signals.

Figure 2:
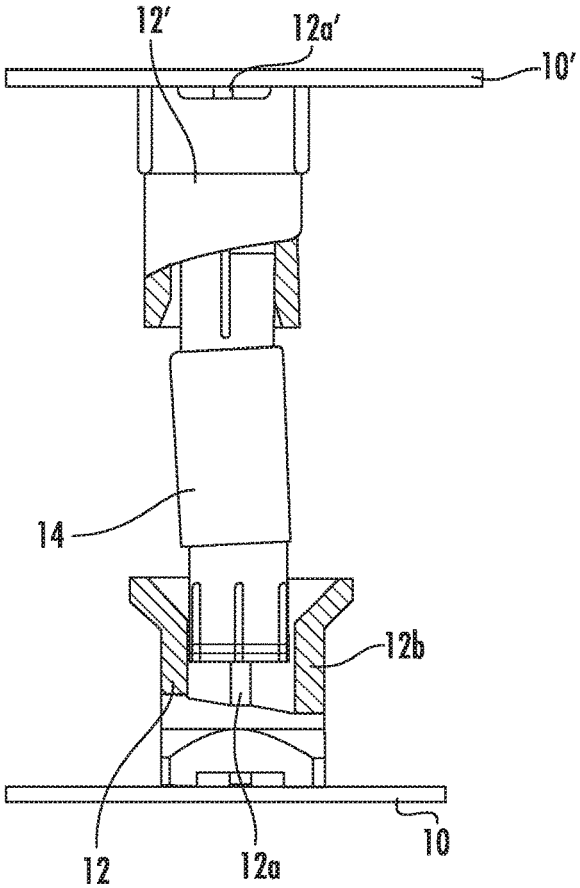
FIG. 2 is a side, partial section view of a prior art B2B connector inserted into two connectors mounted on respective PCBs.

Interconnection between the connectors of two such PCBs is illustrated in FIG. 2, wherein a PCB 10 with a coaxial connector 12 is connected with a second PCB 10' having a coaxial connector 12' via a conventional coaxial B2B connector 14. As can be seen in FIG. 2, the B2B connector 14 is received within the outer connector bodies 12*b*, 12*b*' of the connectors 12, 12' and mates with their male and female inner contacts 12*a*, 12*a*'. FIG. 2 also shows how the B2B connector 14 can interconnect connectors 12, 12' even when they are slightly misaligned radially, and also illustrates that the interconnection provides some axial "float." However, such interconnection requires a separate B2B connector 14 in addition to the connectors 12, 12'.

Figure 3:
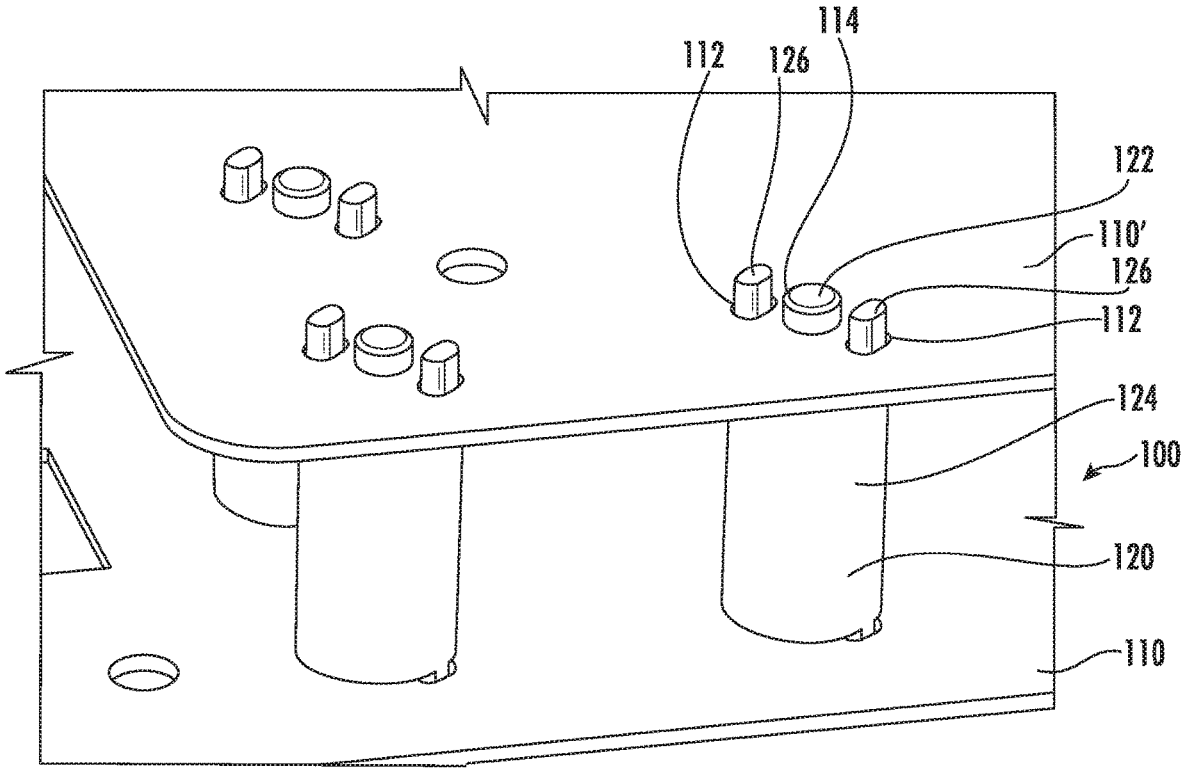
FIG. 3 is a perspective view of an array of B2B connectors mounted on PCBs according to embodiments of the invention.
Figure 4:
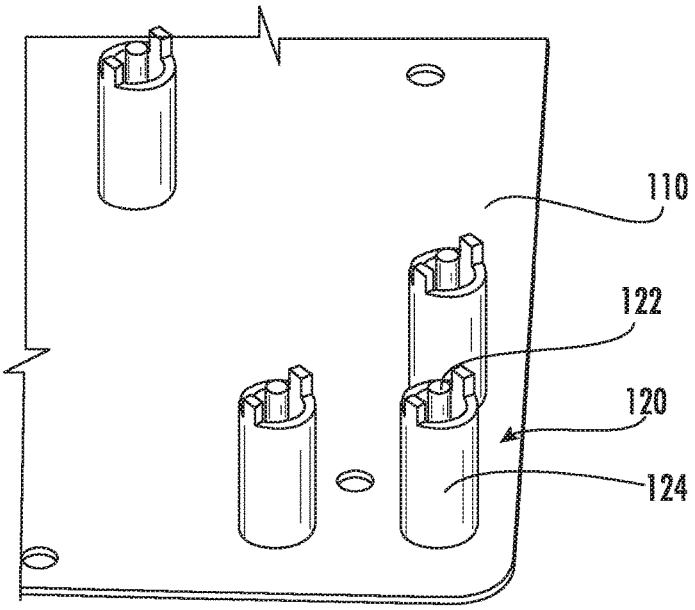
FIG. 4 is a perspective view of the connectors of FIG. 3 with one of the PCBs removed.

Referring now to FIGS. 3 and 4, an assembly, designated broadly at 100, is shown therein. The assembly 100 includes PCBs 110, 110' and a plurality of B2B connectors 120 mounted thereto. Each of the connectors 120 has an inner contact 122 and an outer connector body 124. As can be seen in FIG. 3, each PCB 110, 110' has alignment holes therein: two lateral holes 112 and one central hole 114 corresponding to each connector 120. As shown in FIG. 3, the inner contact 122 of each connector 120 extends through one of the central holes 114, and fingers 126 that extend from the ends of the outer connector body 124 extend through the lateral holes 114. The holes 112, 114 are oversized relative to the fingers 126 and inner contact 122, such that the position of the connector 120 can adjusted relative to the PCBs 110, 110' both axially and radially. Once positioned, the fingers 126 and inner contact 114 can be soldered into place on the PCBs 110, 110', thereby providing an interconnection between these locations on the PCBs 110, 110'. Unlike the interconnection described above in FIG. 2, this board-to-board connection can be made with a single connector 120 and still provide axial and radial float for the connection.

It should be noted that, in some embodiments, the connector 120 may be directly mounted onto one of the PCBs 110, 110', and the other of the PCBs 110', 110 may include the oversized holes 112, 114. In this configuration some axial and radial adjustment of the connector 120 relative to the other of the PCBs 110', 110 is possible. As another alternative, only one of the PCBs 110, 110' may have oversized holes, with the other PCB 110', 110 having holes sized to match the inner contact 122 and the fingers 126.

Figure 5:
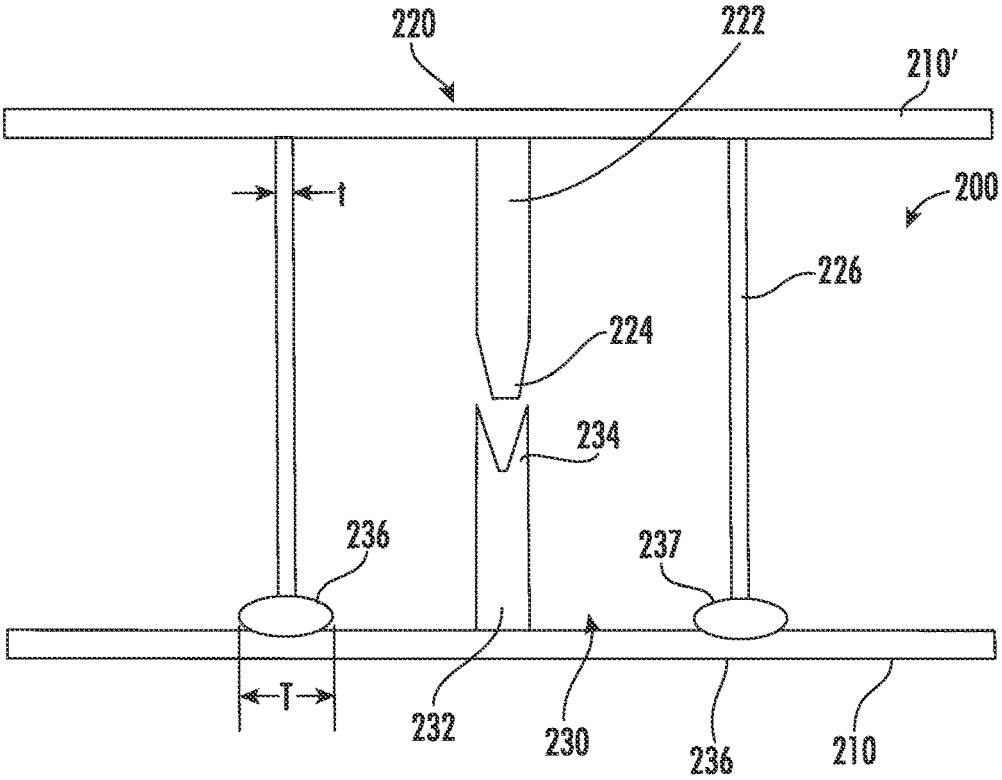
FIG. 5 is a side view of a B2B connector mounted to two PCBs according to alternative embodiments of the invention.

Referring now to FIG. 5, another assembly, designated broadly at 200, is shown therein. The assembly 200 includes PCBs 210, 210' that are interconnected with via two B2B connectors 220, 230. The connector 220 includes a male inner contact 222 with a tapered free end 224 and a cylindrical outer contact 226, each of which is mounted to the PCB 210'. The connector 230 includes a female inner contact 232 with a splayed free end 234 (in some embodiments, the splayed free end 234 has radial slots, such that a series of fingers and gaps are formed) and an annular conductive gasket 236, each of which is mounted to the PCB 210. The gasket 236 is resilient and has a thickness T that is considerably greater than the thickness t of the free end of outer contact 226. The gasket 236 includes an engagement surface 237. Exemplary conductive materials for the gasket 236 include plated polyurethane foam and metal-filled elastomers. In some embodiments, the thickness T of the gasket 236 is at least 2 to 5 times the thickness t of the outer connector body.

Figure 6:
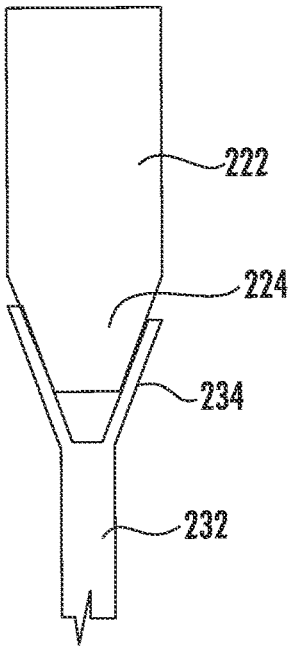
FIG. 6 is an enlarged side view of the interacting ends of the male and female inner contacts of the connector of FIG. 5.

As can be seen in FIG. 5, the connectors 220, 230 can be mated to provide interconnection between the PCBs 210, 210'. As shown in FIG. 6, the free end 224 of the inner contact 222 is received within the splayed free end 234 of the connector 230. The taper of the free end 224 and the presence of the splayed free end 234 enables the inner contacts 222, 232 to engage while still providing some radial and axial float. The outer contact 226 of the connector 220 engages the engagement surface 237 of the gasket 236, establishing electrical contact therebetween. The flexible, resilient nature of the gasket 236 allows the engagement surface 237 to flex in a direction normal to the PCB 210, which can provide axial "float" for mating of the connectors 220, 230, and the width of the gasket 236 can be selected to provide radial float for the connectors 220, 230.

Figure 7:
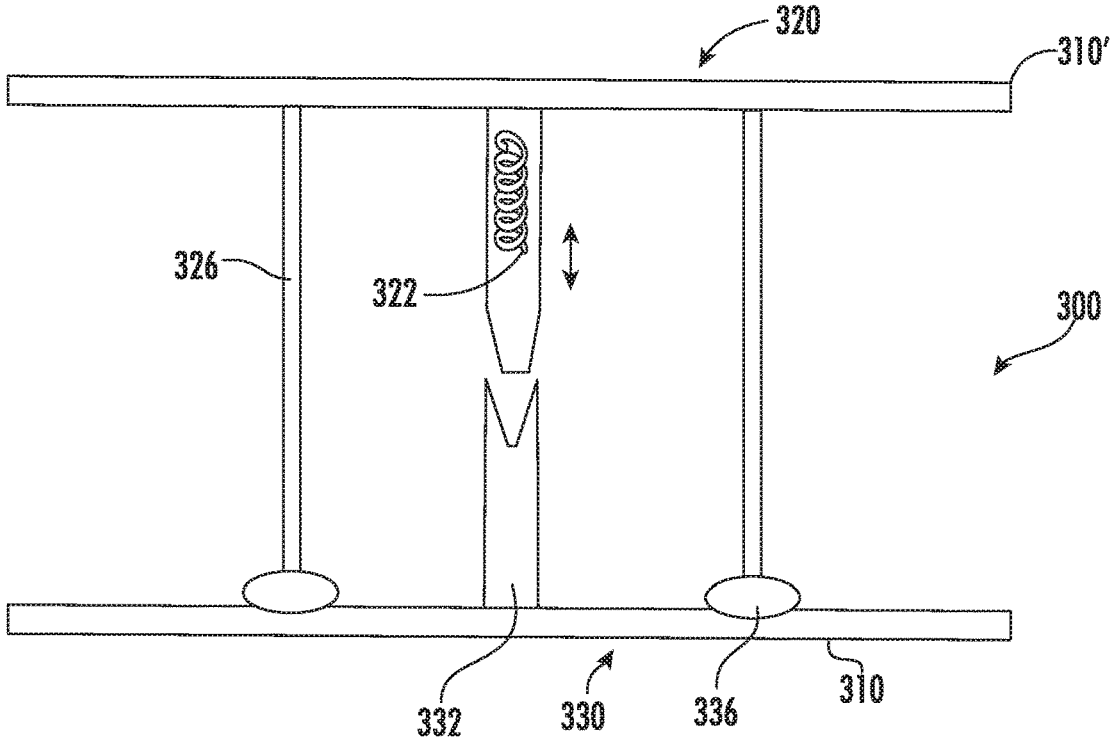
FIG. 7 is a side view of a B2B connector mounted to two PCBs according to additional embodiments of the invention.

Referring now to FIG. 7, another assembly according to embodiments of the invention is shown therein and designated broadly at 300. The assembly 300 is similar to the assembly 200, with connectors 320, 330 mounted on PCBs 310, 310'. The connector 330 is similar to the connector 230, with an inner contact 332 and an outer gasket 336. The connector 320 has an outer contact 326 that is similar to the outer contact 226, but also has a spring-loaded inner contact 322. The spring-loaded contact 322 has the ability to retract axially, which can provide additional axial float when the connectors 320, 330 are mated (i.e., when the inner contact 322 engages the inner contact 332). An exemplary spring-loaded contact is discussed in Chinese Patent Application No. 201910870083.2, filed Sep. 16, 2019, the disclosure of which is hereby incorporated herein in its entirety.

Once mated, in some embodiments the inner contact 322 may be "locked" into its axial position after it has retracted. For example, an adhesive may be introduced into the inner contact 322 to maintain its position. As another example, a one-way "ratchet"-type design may be employed so that the inner contact 322 cannot expand in length once it is retracted.

Figure 8:
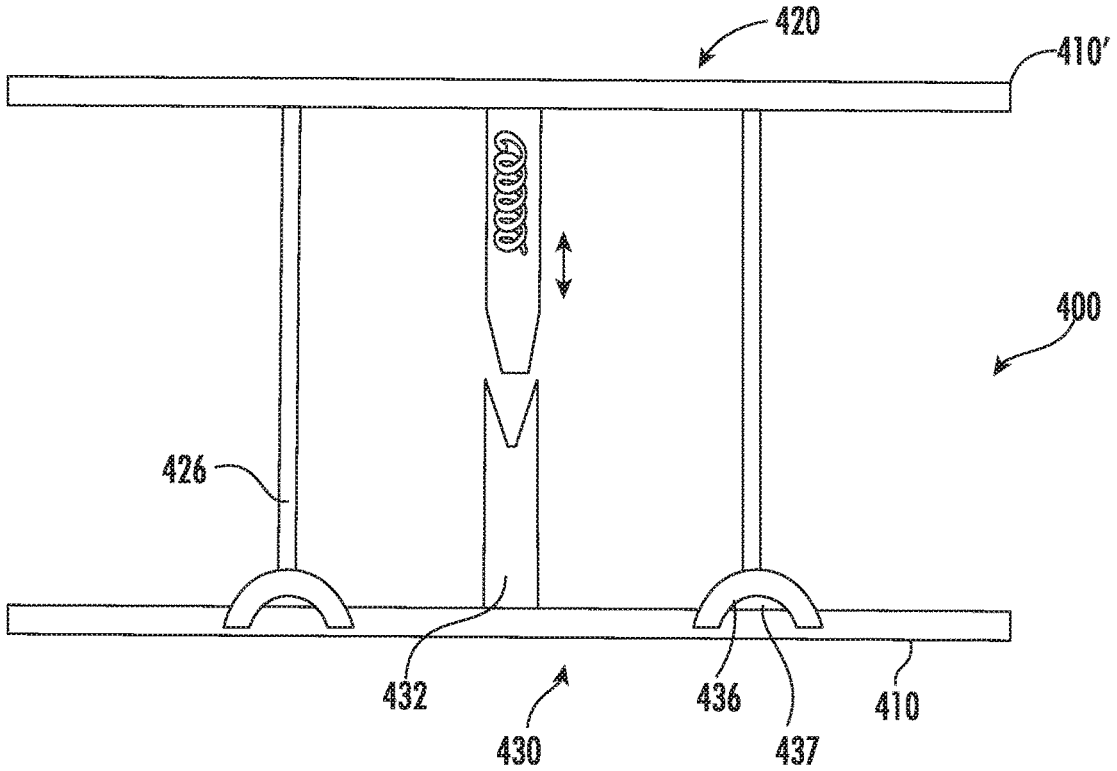
FIG. 8 is a side view of a B2B connector mounted to two PCBs according to further embodiments of the invention.

Referring now to FIG. 8, another assembly according to embodiments of the invention is shown therein and designated broadly at 400. In the assembly 400, a connector 420 that is similar to the connector 320 is mounted to a PCB 310'. A connector 430 is mounted to a PCB 410. The inner contact 432 of the connector 430 is similar to the inner contact 332. However, the connector 430 includes a raised, flexible, conductive annular landing pad 436 rather than a flexible gasket. As shown in FIG. 8, the landing pad 436 may include a cavity 437 between the landing pad 436 and the PCB 410 to facilitate flexing of the landing pad 436 toward the PCB 410 (i.e., in a direction normal to the PCB 410). Exemplary materials for the landing pad 436 include beryllium-copper alloys and the like.

When the connectors 420, 430 are mated, the free end of the outer contact 424 of the connector 420 engages the landing pad 436 and causes it to flex toward the PCB 410. Like the gasket 236 described above, the width and flexibility of the landing pad 436 can provide axial and radial float for the engagement of the outer contact 426 and the landing pad 436.

Those of skill in this art will appreciate that the connectors 220, 230, 320, 330, 420, 430 may take other forms. For example, the gaskets 236, 336 and landing pad 436 may be replaced with another flexible structure that can deflect in a direction normal to its underlying PCB when engaged by the outer connector body 226, 326, 426 of the mating connector 220, 320, 420. The gaskets 236, 336 and/or the landing pad 436 are illustrated as being annular, but may define a discontinuous annulus. Similarly, the outer connector bodies 226, 326, 426 may have engagement surfaces on their free ends that make discontinuous contact with the gasket or landing pad. In some instances either the outer connector body or the gasket/landing pad may include a dielectric layer that engages its mating component, such that the coupling between the outer connector body and the gasket/landing pad is capacitive rather than being galvanic.

Figure 9:
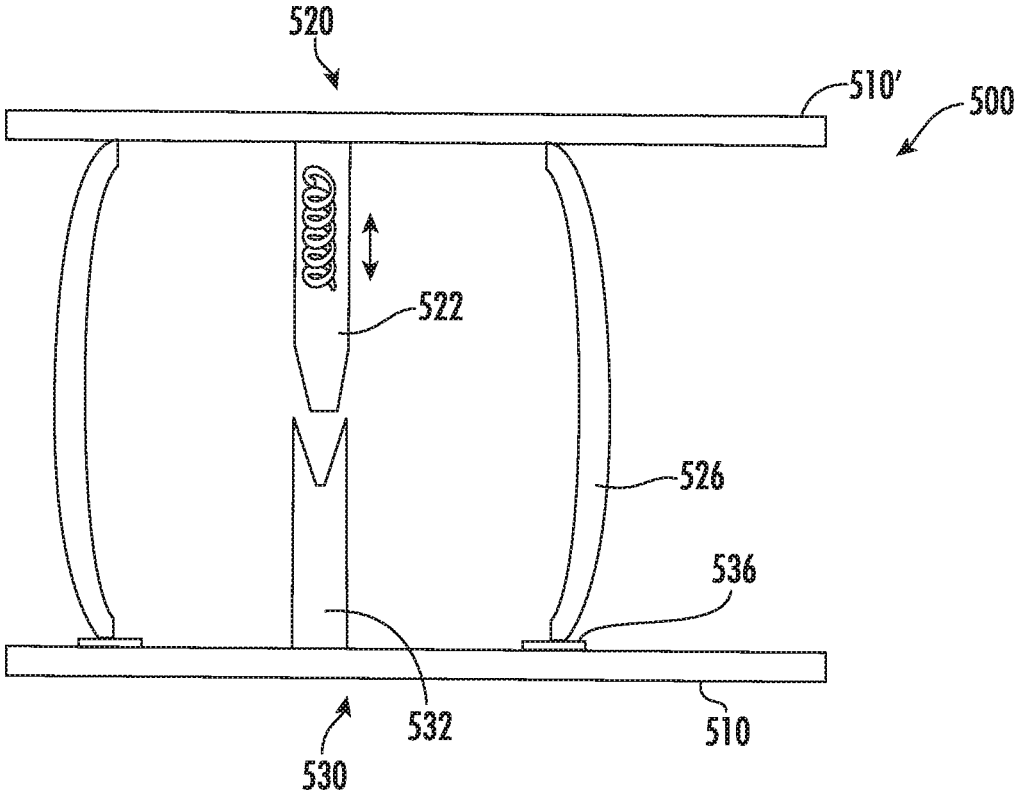
FIG. 9 is a side view of a B2B connector mounted to two PCBs according to still further embodiments of the invention.

Referring now to FIG. 9, another assembly according to embodiments of the invention is shown therein and designated broadly at 500. The assembly 500 includes a connector 520 that is mounted to the PCB 510'. The connector 520 has an inner contact 522 similar to the inner contact 422, and has an outer contact 526 that has flexible walls (these are illustrated in FIG. 9 as being slightly arcuate in profile). Exemplary materials for the outer contact 526 include beryllium-copper alloys and the like. The assembly 500 also includes a connector 530 mounted to the PCB 510 that includes an inner contact 532 similar to the inner contact 522 and a flat annular landing pad 536.

Figure 10:
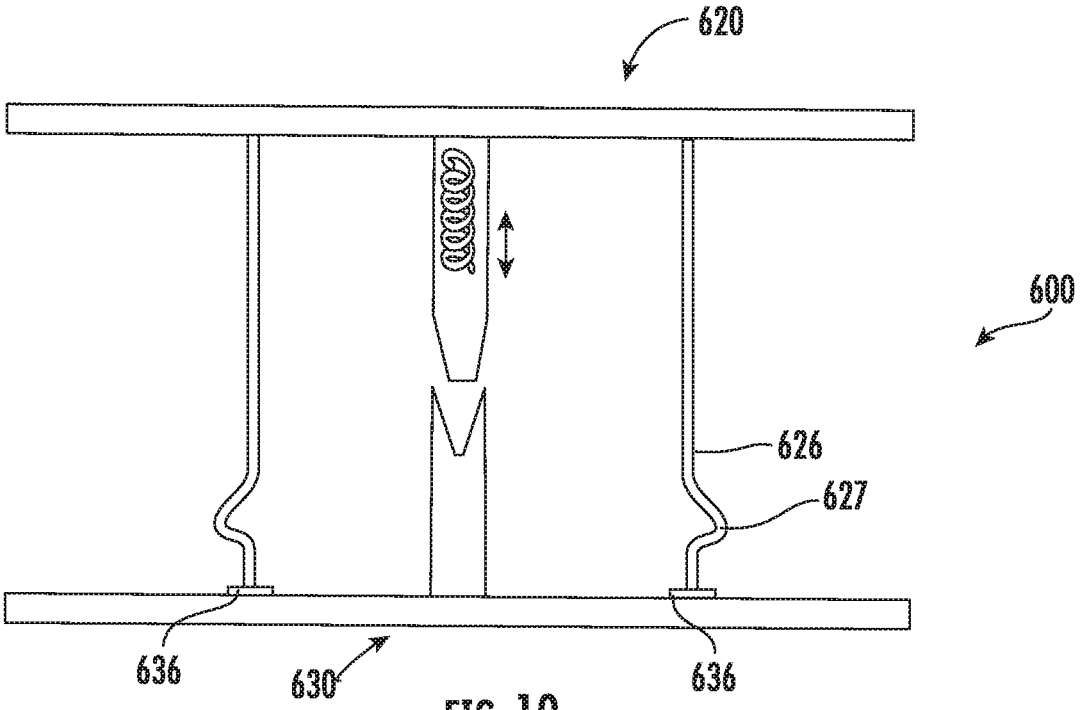
FIG. 10 is a side view of a B2B connector mounted to two PCBs according to yet further embodiments of the invention.

Mating of the connectors 520, 530 causes the inner contacts 522, 532 to mate as described above, and the outer contact 526 to engage the landing pad 536. Engagement of the outer contact 526 with the landing pad 536 causes the outer contact 526 to bow radially outward. This manner of engagement provides axial and radial float between the mating connectors 520, 530. In this embodiment, the landing pad 536 is not illustrated as being configured to flex toward and away from the PCB 510 as described in connection with the landing pad 436, but in some embodiments the landing pad 536 may have such flexing capability. As another example, FIG. 10 illustrates an alternative assembly 600 in which the outer contact 626 of the connector 620 is formed with a compressible protrusion 627. When the connectors 620, 630 are engaged, the outer contact 626 can deflect at the protrusion 627 to provide axial float as it contacts the landing pad 636.

Those of skill in this art will appreciate that the connectors 520, 620 illustrated herein may take different forms. For example, the outer connector bodies 526, 626 may be configured to bow radially inwardly rather than radially outwardly. As another example, the outer connector body may be corrugated, such that the outer conductor body compresses in accordion fashion upon engagement with the mating landing pad. Other possibilities will be apparent to those of skill in this art.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An assembly comprising:

first and second printed circuit boards (PCBs), the PCBs being disposed generally parallel to each other;

a first coaxial connector mounted to the first PCB, the first coaxial connector comprising a first inner contact and a first outer connector body, the first outer connector body having a first thickness; and a second coaxial connector mounted to the second PCB, the second axial connector comprising a second inner contact and a second outer connector body;

wherein the second outer connector body includes an engagement surface, the engagement surface being flexible in a direction normal to the second PCB, the engagement surface having a second thickness that is greater than the first thickness, the engagement surface engaging the first outer connector body.

2. The assembly defined in claim 1, wherein the second outer connector body comprises a conductive gasket.

3. The assembly defined in claim 1, wherein the second outer conductor body comprises a raised contact pad.

4. The assembly defined in claim 1, wherein the first inner contact has a tapered free end, and the second inner contact has a splayed free end.

5. The assembly defined in claim 1, wherein the first inner contact is configured such that a free end thereof can retract and extend axially relative to the first PCB.

6. The assembly defined in claim 5, wherein the first inner contact can be secured into a retracted position.

7. The assembly defined in claim 4, wherein the second outer conductor body comprises one of a conductive gasket and a raised contact pad.

8. The assembly defined in claim 5, wherein the second outer conductor body comprises one of a conductive gasket and a raised contact pad.

9. An assembly comprising: first and second printed circuit boards (PCBs), the PCBs being disposed generally parallel to each other; and a coaxial connector mounted to the first PCB and to the second PCB, the coaxial connector comprising an inner contact with a first axial projection and a first outer connector body having a second axial projection: wherein the first PCB includes oversized mounting holes for the first and second axial projections, such that the axial and radial positions of the inner contact and the first outer connector body can be adjusted relative to the first PCB prior to mounting thereto; and a second outer connector body: wherein the second outer connector body includes an engagement surface, the engagement surface being flexible in a direction normal to the second PCB, the engagement surface having a second thickness that is greater than the first thickness, the engagement surface engaging the first outer connector body.

10. The assembly defined in claim 9, wherein the inner contact comprises a third axial projection and the second outer connector body comprises a fourth axial projection: and wherein the second PCB includes oversized mounting holes for the third and fourth axial projections, such that the axial and radial positions of the inner contact and the second outer connector body can be adjusted relative to the second PCB prior to mounting thereto.

11. An assembly comprising:

first and second printed circuit boards (PCBs), the PCBs being disposed generally parallel to each other;

a first coaxial connector mounted to the first PCB, the first coaxial connector comprising a first inner contact and a first outer connector body having a free end surface with a first thickness; and a second coaxial connector mounted to the second PCB, the second axial connector comprising a second inner contact and a second outer connector body;

wherein the second outer connector body includes an engagement surface, the engagement surface having a second thickness that is greater than the first thickness; and wherein the first outer connector body is configured to bow radially under axial compression induced by engagement between the free end surface of the first outer connector body and the engagement surface of the second outer connector body.

12. The assembly defined in claim 11, wherein the first inner contact has a tapered free end, and the second inner contact has a splayed free end.

13. The assembly defined in claim 11, wherein the first inner contact is configured such that a free end thereof can retract and extend axially relative to the first PCB.

14. The assembly defined in claim 13, wherein the first inner contact can be secured into a retracted position.

* * * * *